United States Patent [19]

Kojima et al.

[11] Patent Number: 4,650,714

[45] Date of Patent: Mar. 17, 1987

[54] INK JET RECORDING SHEET

[75] Inventors: Yutaka Kojima; Takashi Omori; Koichi Nagai, all of Tokyo, Japan

[73] Assignee: Jujo Paper Co., Ltd., Tokyo, Japan

[21] Appl. No.: 777,238

[22] Filed: Sep. 18, 1985

[30] Foreign Application Priority Data

Sep. 19, 1984 [JP] Japan ..... 59-195986

[51] Int. Cl.[4] ..... B41M 5/00

[52] U.S. Cl. ..... 428/341; 346/135.1; 427/261; 428/195; 428/423.1; 428/423.7

[58] Field of Search ..... 346/135.1; 427/261; 428/195, 207, 211, 341, 342, 913, 914, 423.1, 423.7

[56] References Cited

U.S. PATENT DOCUMENTS 4,358,380 11/1982 Hasagaua et al. ..... 210/679

FOREIGN PATENT DOCUMENTS 0102391 6/1982 Japan ..... 428/195

*Primary Examiner*—Bruce H. Hess

*Attorney, Agent, or Firm*—Koda and Androlia

[57] ABSTRACT

An ink jet recording sheet for overhead projection or blue copy comprising on a transparent or translucent support an ink-absorbing layer which is made by coating an organic solvent which contains a denatured polyethylene oxide being soluble in the organic solvent and having a water absorbing ability onto the transparent or translucent support. The ink jet recording sheet which results provides excellent ink drying ability and high optical density, and is excellent for overhead projection or blue copy.

4 Claims, No Drawings

INK JET RECORDING SHEET

BACKGROUND OF THE INVENTION

1. Field of the Invention

The present invention relates to a recording sheet for overhead projectors (OHP) or second original drawing, which is suitable for ink jet recording.

2. Prior Art

Usually, transparent resin films represented by polyester film are used as sheets for OHP. Recording of pictures is made using methods such as handwriting with ink, toner transfer with PPC, heat-sensitive foaming, etc.

Attempts to apply an ink jet recording method to OHP have been made, since it is excellent in distinctness and polychromy of pictures. However, in the case where records are placed on an ordinary film for OHP using an ink jet printer, ample time is required for the ink to dry because the base material has no ink-absorbing ability, and the running, fade-out or uncleaniness of pictures is caused by the ink is not being dried. Also, in the case of polychrome recording, a compound color or bleeding due to the superposition of inks is observed. Further, ink wetting to the surface of the base material is bad, and the inks do not spread out to the desired extent, whereby the apparent density of the ink is held low and recording is poor in practicality.

Therefore, in order to endow ink absorbing and drying abilities, methods of preparing a coated film layer by dispersing organic particles and inorganic particles into a binding agent have been proposed in Japanese Patent Disclosures No. 57-14091, No. 56-99692 and No. 57-107880.

In the above method, however, only a slight improvement has been shown in the ink-absorbing ability or ink-drying ability. The conventional recording sheets have suffered the following disadvantages. Even if they have ink-absorbing abilities to some extent, they are deficient in transparency for OHP use. Also, even if they are excellent in transparency, ink dots do not spread out to the desired extent, whereby an adequate optical density can not be obtained. Even after printing and drying, ink tacks do not disappear, whereby the sheets are easily soiled.

SUMMARY OF THE INVENTION

It is the general object of the present invention to provide an ink jet recording sheet for OHP or blue copy, the recording sheet being excellent in ink drying ability, presenting no flowing or running of ink due to the superposition of them in multi-color recording, having a high recording consistency of ink, and possessing a sufficient transparency for practical use. The above-mentioned object can be performed by using on a transparent or translucent support an ink-accepting layer which is made by coating an organic solvent coating color which contains a resin being soluble in the organic solvent and having a water absorbing ability, said resin being a denatured polyethylene oxide obtained by allowing 0.19–5% by weight of a monocyanate or polyisocyanate compound to react with an ethylene oxide polymer having an average molecular weight of above 100,000.

DETAILED DESCRIPTION OF THE INVENTION

The resin used in the invention should have the properties of being soluble in an organic solvent and possessing a water absorbing ability. The example of the resin having such properties includes a resin (hereinafter referred to as denatured polyethylene oxide) which is obtained, as described in Japanese Patent Laid-open No. 50-36280, by allowing 0.01–5%, by weight, of a monoisocyanate or polyisocyanate compound to react with an ethylene oxide polymer having an average molecular weight of over 100,000 or a copolymer mainly composed of ethylene oxide for making it insoluble in water.

There are many resins having water absorbing abilities. They are divided into starch-based (acrylonitrile hydrolysis products, acrylic acid grafted products), cellulose-based (graft polymers, carboxymethylated products) and synthetic resin-based (polyvinyl alcohol-based, polyacrylic salt-based, polyethylene oxide-based). Although these resins have water-absorbing abilities, they have no water solubility and are hard to dissolve in organic solvents. It has been reported in Japanese Patent Disclosure No. 57-173194 and No. 58-24492 that fine powders (particle size: 0.02–100 μm) of water absorbing resins are mixed in or painted to make ink jet recording sheets, not to mention the case where the resin particles are mixed in, light scattering occurs due to the presence of undissolved resin particles or other causes, whereby only recording sheets poor in transparency can be obtained. The sheets thus obtained cannot be used for OHP and second original drawing.

The resin used in the invention is soluble in organic solvents. Since the resin is applied after dissolution in an organic solvent, a coating layer excellent in transparency can be obtained. Further, the resin used in the invention is required to have a water absorbing ability. The amount of water absorbed may range from 1 to 50 times by weight, preferably from 5 to 25 times by weight of the resin itself when it is soaked in ion exchange water at 25° C. for 30 minutes in view of the fixing and drying of ink and image water water resistance. In the case where a resin excellent in water absorbing ability to an excess is used, it does not reduce the ink fixing and drying times. Also, if the recording sheet is moistened by water, ink dots do not hold their shape due to the swelling of a coating layer, resulting in indistinct images and the impossibility of reading. Further, the coating layer may come off its support due to the swelling.

The above-mentioned resin used in the invention is dissolved in an approriate organic solvent such as toluene, isopropyl alcohol, ethylene dichloride or the like. The resultant solution is then coated on the support in quantities of about 2–15 g/m$^2$ (dry weight) to form an ink absorbing layer.

Incidentally, examples of the transparent support include a glass sheet, plastic film (polyethylene, polystyrene, polypropylene, vinyl chloride-vinylidene chloride copolymer, polyvinyl copolymer), cellophane, etc. Examples of the translucent support include the above-mentioned plastic film (translucent), glassine paper, tracing paper, etc.

Further, the addition of polyvinyl butyral, polyvinyl acetate, polyethelenevinyl acetate copolymer or other vinyl-based resin to the above-mentioned ink accepting layer has the effects of improving the transparency and suppression of ink dot spreading. Besides, polyesters (e.g. Toyobo Bailon 200) and a like have the effect of controlling the ink dot spreading to the desired extent. The amount of these additive resins compounded may preferably range from 5 to 50% by weight, more preferably from 20 to 40% by weight to the resin like denatured polyethylene oxide, which is soluble in an organic solvent and possesses a water absorbing quality.

In the present invention, the resin soluble in an organic solvent and possessing a water absorbing ability is dissolved in the organic solvent, and then the resultant solution is coated on the support. As a result, a uniform layer containing no minute particles is formed, thereby presenting a good transparency. Further, ink droplets are quickly absorbed due to the moderate water absorbing ability of the resin in ink jet recording, and are spread out to a certain extent, which is maintained.

Embodiments

The present invention will be described hereinafter by way of examples.

EXAMPLE 1

Denatured polyethylene oxide (Aquapren L-710 made by Meisei Chemical Industries Co., Ltd., solid content: 15%) was dissolved in isopropyl alcohol (IPA) with stirring to form a solution (solid content: 10%). The resin solution thus formed was coated on a polyester film of 100 μm thickness in quantities of 7 g/m$^2$ with a wire bar to obtain a sheet for recording.

EXAMPLE 2

Powdered polyvinyl butyral (PVB; Eslex B1-3 made by Sekiksui Chemical Co., Ltd.) was soley added to IPA. Then, the former was dissolved in the latter with stirring to form a 10% solution. Hereafter, this PVB solution was fully mixed with the denatured polyethylene oxide solution obtained in Example 1 at a compounding ratio of 3:7. The resultant mixed solution was coated on a transparent support in the same manner as in Example 1 to obtain a sheet for recording.

COMPARATIVE EXAMPLES 1-6

Bridged polyacrylate (Aquakeep 4S made by Seitetsu Kagaku Kogyo Co., Ltd.), bridged acrylamide acrylate copolymer (Hymosab 200 made by Kyoritsu Yukikogyo Kenkyusho), bridged starch-acrylic acid copolymer (Sunwet IM.1000PMS made by Sanyo Chemical Co., Ltd.) and starch-polyacrylonitrile graft copolymer (WAS made by Nichiden Chemical Co., Ltd.) were respectively dispersed in the solved IPA to the extent of 30%. Then, each dispersed resin is ground to finely divided particles using an attriter to obtain a dispersion liquid for each powdered resin possessing a high water absorbing ability. Hereafter, the PVB solution used in Example 2 is mixed in as a binding agent with each dispersion liquid in the compounding ratio shown in Table 1. The resultant mixed solution is coated onto a polyester film in the same manner as in Example 1 to obtain a recording film.

COMPARATIVE EXAMPLE 7

Bridged polyacrylate (Aquakeep 4S) powder used in Comparative Example 1 was mixed with a water-soluble binding agent, polyvinyl alcohol (PVA 117 made by Kurare Co., Ltd.). The resultant mixed solution was coated onto a polyester film in the same manner as in Example 1 to obtain a recording film.

COMPARATIVE EXAMPLES 8 AND 9

Using urea-formalin resin powder (Pargopak M made by CIBA BEIBY CO., LTD.) and synthesized silica (Mizubasil NP-8 made by Mizusawa Chemical Co., Ltd.) known as loading materials in an ink accepting layer, PVB or polyvinylpyrrolidone is mixed in as a binding agent with each of them in the compounding ratio shown in Table 1. The resulant mixed solution was coated onto a polyester film in the same manner as in Example 2 to obtain a recording film.

EXAMPLE 3

A recording sheet was obtained by following the procedure in Example 2 but the PVB solution was mixed with the denatured polyethylene solution at a solid content ratio of 1:1.

EXAMPLES 4 AND 5

A recording sheet was obtained by following the procedure in Example 3 but polyvinyl acetate (Vinylol 15 made by Showa Kobunshi Co., Ltd.) or polyethylenevinyl acetate copolymer (Soalex SE830 made by Nippon Goseikagaku Co., Ltd.) was used instead of the PVB solution.

Accordingly, in the present invention since a sheet with excellent transparency can be obtained, it is possible to apply distinctive and multi-color picturing using the advantageous ink jet recording to sheets for OHP and second drawing. Further, the ink accepting layer containing the resin soluble in an organic solvent and possessing a water absorbing ability is excellent in absorption of ink droplets and suppression of spreading, whereby an ink jet recording sheet can be obtained which is excellent in ink drying ability, picture depth and multi-color recording.

TABLE 1

| Test Results | | | | | | |
|---|---|---|---|---|---|---|
| | Ink acceptor layer | | | | Sheet properties | |
| | Polymer having high water absorbing ability (Trade name water absorbing ability) | | Binder | | Coating amount | Light permeability |
| Example 1 | Modified Polyethylenoxide (AQUAPRENE) | 100 parts | — | | 6.4 | 62.7 |
| Example 2 | Modified Polyethylenoxide (AQUAPRENE) | 70 parts | Polyvinylbutyral | 30 parts | 9.8 | 68.2 |
| Example 3 | Modified Polyethylenoxide (AQUAPRENE) | 50 parts | " | 50 parts | 6.3 | 75.5 |
| Example 4 | Modified Polyethylenoxide | 50 parts | Polyvinylacetate | 50 parts | 6.0 | 72.7 |

TABLE 1-continued

Test Results

| | Ink acceptor layer: Polymer having high water absorbing ability (Trade name water absorbing ability) | | Binder | | Sheet properties: Coating amount | Light permeability |
|---|---|---|---|---|---|---|
| Example 5 | (AQUAPRENE) Modified Polyethylenoxide | 50 parts | Polyethylenvinyl-acetate-copolymer | 50 parts | 8.6 | 73.5 |
| Reference example 1 | (AQUAPRENE) Polyacrylic acid cross-linked material | 95 parts | Polyvinylbutyral | 5 parts | 7.2 | 7.8 |
| Reference example 2 | (AQUAKEEP 4S 720 g/g) Polyacrylic acid cross-linked material | 70 parts | Polyvinylbutyral | 30 parts | 10.1 | 2.0 |
| Reference example 3 | (AQUAKEEP 4S 720 g/g) Polyacrylic acid cross-linked material | 30 parts | Polyvinylbutyral | 70 parts | 5.7 | 55.2 |
| Reference example 4 | (AQUAKEEP 4S 720 g/g) Acrylic acid-acrylamide copolymer | 95 parts | Polyvinylbutyral | 5 parts | 11.0 | 13.7 |
| Reference example 5 | (HIMOSAB 200, 552 g/g) Starch-acrylic acid copolymer (SANWET IM-1000 MPS, 414 g/g) | 70 parts | Polyvinylbutyral | 30 parts | 11.5 | 1.3 |
| Reference example 6 | Starch-acrylnitrile graft copolymer (WAS, 450 g/g) | 70 parts | Polyvinylbutyral | 30 parts | 9.4 | 8.0 |
| Reference example 7 | Polyacrylic acid cross-linked material (AQTUAKEEP 4S, 720 g/g) | 95 parts | Polyvinyl alcohol | 5 parts | 9.3 | 17.1 |
| Reference example 8 | Urea-formaldehyde resin (Pargopak M) | 30 parts | Polyvinylpyrrolidone | 35 parts | 13.9 | 4.3 |
| Reference example 9 | Synthetic silicon dioxide (Mizukasil NP-8) | 30 parts | Polyvinylbutyral " | 35 parts 70 parts | 5.6 | 2.8 |

| | Recording sheet: Optical density: Black | Cyan | Magenta | Yellow | Ink-drying time (Sec) | Bleeding | Shape of dots | Diameter of dot |
|---|---|---|---|---|---|---|---|---|
| Example 1 | 1.03 | 1.15 | 1.51 | 1.35 | 156 | Δ | o | 175 |
| Example 2 | 0.79 | 0.77 | 1.25 | 1.03 | 90 | o | o | 164 |
| Example 3 | 0.92 | 1.10 | 1.43 | 1.19 | 130 | Δ | o | 158 |
| Example 4 | 0.78 | 1.04 | 1.41 | 1.09 | 150 | Δ | o | 162 |
| Example 5 | 0.80 | 0.94 | 1.35 | 1.07 | 210 | Δ | Δ | 150 |
| Reference example 1 | 0.89 | 0.73 | 0.83 | 0.82 | 170 | Δ | x | — |
| Reference example 2 | 0.94 | 0.82 | 0.95 | 0.91 | 145 | Δ | Δ | 145 |
| Reference example 3 | 0.49 | 0.34 | 0.44 | 0.46 | 300< | x | x | — |
| Reference example 4 | 0.50 | 0.46 | 0.52 | 0.51 | 170 | x | x | — |
| Reference example 5 | 1.06 | 0.97 | 1.06 | 1.09 | 150 | Δ | Δ | 162 |
| Reference example 6 | 0.88 | 0.79 | 0.88 | 0.90 | 270 | Δ | Δ | 156 |
| Reference example 7 | 0.84 | 0.74 | 0.89 | 0.80 | 300< | x | x | — |
| Reference example 8 | 0.56 | 0.61 | 0.71 | 0.71 | 300< | x | o | 151 |
| Reference example 9 | 0.57 | 0.50 | 0.55 | 0.55 | 300< | x | o | 132 |

1. Light permeability

The light permeability of each recording sheet was measured at 550 nm using a Hitachi spectrophotometer 220A.

2. Optical Density

Using a Sharp ink jet color image printer IO-700 (hereafter called printer), all over records (size: 1.5 cm×2.0 cm) of four colors (black, cyan, yellow, magenta) were made. With a paper of 90% brightness as background, the recorded portions were measured using a Macbeth densitometer (Kollmorgen Corporation Macbeth RD915).

3. Ink-drying ability

Black all over records were made using a printer in the same manner as in (2). Touching the recorded portions with the finger, the time required for the ink to become unable to transfer to the finger was measured.

4. Bleeding

Multi-color recording was performed by making red, green and purple records successively in a similar manner to in (2). At the time, the degree of running of neighboring inks to each other or one side was evaluated.

Very small—O

Some degree—Δ

Marked—X

5. Shapes of dots

When English letters were printed with black using a printer, the shapes of the dots were evaluated.

All dots were almost circular in shape—O
Some dots were square or misshaped—Δ
Illegible—X 6. Diameter of dots The dots printed in (5) were magnified 50 times using a universal projector (Nippon Kagaku SHADOW GRAPH model 6). The diameters of the magnified dots were measured. The measured value was the average of 10 measurements.

Immeasurable diameter due to misshapen dots are denoted by "-".

We claim:

1. An ink jet recording sheet for OHP or blue copy on a transparent or translucent support which comprises an ink-accepting layer which is made by coating an organic solvent which contains a resin being soluble in the organic solvent and having a water absorbing ability onto the support, said resin being a denatured polyethylene oxide obtained by allowing 0.9–5% by weight of a monocyanate or polyisocyanate compound to react with an ethylene oxide polymer having an average molecular weight of above 100,000.

2. An ink jet recording sheet according to claim 1, in which said resin has a water absorbing ability of 1 to 50 times by weight of said resin itself in soaking in ion exchange water at 25° C. for 30 minutes.

3. An ink jet recording sheet according to claim 1, in which said resin has a water absorbing ability of 1 to 25 times by weight of said resin itself in soaking in ion exchange water at 25° C. for 30 minutes.

4. An ink jet recording sheet according to claim 1, in which said ink-absorbing layer is made by coating 2–15 $g/m^2$ on a dry basis of said organic solvent.

* * * * *